US010465355B2

(12) United States Patent
Barron et al.

(10) Patent No.: US 10,465,355 B2
(45) Date of Patent: Nov. 5, 2019

(54) INJECTION TUBE COUNTERSINKING

(71) Applicant: Uretek USA, Inc., Tomball, TX (US)

(72) Inventors: Brent J. Barron, Tomball, TX (US); Edward Hibbard, Conroe, TX (US); Matthew Sotirin, Spring, TX (US); Chris Phelps, Montgomery, TX (US)

(73) Assignee: Uretek USA, Inc., Tomball, TX (US)

( * ) Notice: Subject to any disclaimer, the term of this patent is extended or adjusted under 35 U.S.C. 154(b) by 0 days.

(21) Appl. No.: 16/120,079

(22) Filed: Aug. 31, 2018

(65) Prior Publication Data

US 2019/0071832 A1 Mar. 7, 2019

Related U.S. Application Data

(60) Provisional application No. 62/554,975, filed on Sep. 6, 2017.

(51) Int. Cl.
*E02D 3/12* (2006.01)
*E02D 37/00* (2006.01)

(52) U.S. Cl.
CPC ..... *E02D 3/12* (2013.01); *E02D 37/00* (2013.01); *E02D 2250/003* (2013.01); *E02D 2300/0014* (2013.01)

(58) Field of Classification Search
CPC ..... E02D 3/12; E02D 3/123; E02D 2250/003
See application file for complete search history.

(56) References Cited

U.S. PATENT DOCUMENTS 4,567,708 A * 2/1986 Haekkinen ..... E02D 35/00 404/78
5,542,782 A * 8/1996 Carter, Jr. ..... E02D 5/18 37/344
5,722,800 A * 3/1998 Esters ..... E02D 3/12 405/138
5,836,390 A * 11/1998 Apps ..... C09K 17/12 166/281
5,927,907 A * 7/1999 Shiraishi ..... E02D 3/00 166/401
6,050,207 A * 4/2000 Mays ..... E02D 27/00 114/45
6,634,831 B2 * 10/2003 Canteri ..... E02D 3/12 405/263
6,821,056 B1 * 11/2004 Mansour ..... E02D 27/48 405/230
7,461,997 B1 * 12/2008 Mack, II ..... E01C 23/10 404/101
9,790,655 B1 * 10/2017 Dominguez ..... E02D 3/12
10,138,641 B2 * 11/2018 Tabatabai ..... E02D 37/00
2004/0037653 A1 * 2/2004 Kelso ..... E02D 27/48 405/236
2007/0163203 A1 * 7/2007 Price ..... E02D 27/01 52/834

(Continued)

*Primary Examiner* — Benjamin F Fiorello
(74) *Attorney, Agent, or Firm* — Norton Rose Fulbright US LLP

(57) ABSTRACT

Methods, and apparatuses used in those methods, of countersinking injection tubing below the surface of a structure, such as pavement, so that injection tubing will not extend above the surface of the structure even after movement of the soil, for example, due to frost heave or shrink-swell. Some embodiments employ an injection tube extension and/or an injection tube advancer to countersink the injection tubing within the soil beneath a structure.

5 Claims, 9 Drawing Sheets

(56) References Cited

U.S. PATENT DOCUMENTS

| | | | | |
|---|---|---|---|---|
| 2010/0135731 | A1* | 6/2010 | Barron | E02D 3/12 405/263 |
| 2010/0272518 | A1* | 10/2010 | Barron | E02D 3/123 405/302.4 |
| 2011/0103898 | A1* | 5/2011 | Wang | E02D 3/12 405/266 |
| 2012/0328375 | A1* | 12/2012 | Perkins | E02D 5/74 405/233 |
| 2013/0129423 | A1* | 5/2013 | Hakkinen | E02D 27/34 405/128.7 |
| 2014/0017015 | A1* | 1/2014 | Hakkinen | E02D 27/34 405/233 |
| 2016/0017562 | A1* | 1/2016 | Barron | E02D 5/34 405/240 |
| 2017/0073919 | A1* | 3/2017 | Barron | E02D 3/12 |
| 2018/0016765 | A1* | 1/2018 | Baldwin | E02D 27/48 |

* cited by examiner

INJECTION TUBE COUNTERSINKING

CROSS-REFERENCE TO RELATED APPLICATIONS

This Application claims the benefit of priority to U.S. Provisional Patent Application Ser. No. 62/554,975 filed Sep. 6, 2017, all of which is incorporated herein by reference in its entirety.

FIELD OF INVENTION

The present invention relates to soil stabilization and particularly to methods and apparatuses used in the methods of countersinking injection tubing within soil to prevent the tubing from extending above a structure built on the soil, for example, due to frost heave.

BACKGROUND

Any structure requires the soil beneath it to have sufficient bearing capacity to support it. Otherwise, the settling or movement of the soil after the structure is built can cause it to fail. Many solutions to this problem have been developed, including injecting materials, such as expanding polyurethane material, into the soil beneath the structure (or where the structure will be built) to densify the soil and increase its bearing capacity. This is typically performed by placing tubing into the soil to the desired depth for injection of the material and then forcing the material through the tubing into the soil. The injection tubing often can extend some distance upwards from the surface of the structure built on the soil after the material has been injected.

Extension of the tubing above a structure may be a problem in certain situations, such as when the structure is a runway or road because the tubing may cause damage to tires or other equipment or harm to individuals. Even when the tubing is placed flush or slightly below the surface of the structure, movement of the soil due to natural phenomena such as frost heave or shrink-swell may push the tubing out of the soil so that it extends above the surface of the structure. Frost heave occurs when the soil expands due to freezing and then contracts when it thaws. Shrink-swell occurs when the soil expands or contracts due to heavy rainfall or drought. Tubing within the soil may be pushed out of the soil when it expands due to such phenomena and may not return to its original position within the soil when it contracts.

Removing tubing from the soil before the injected material cures is generally not an option due the very fast cure times of the materials used. Removing tubing from the soil during or after material curing can cause significant damage to the material and even destabilize the soil. It can also be very expensive, time-consuming, and difficult to remove the tubing from the soil during or after material curing due to forces exerted by the material on the tubing. These forces can cause the tubing to stretch or fracture (e.g. tear) when attempting to remove it, making it even more difficult to remove the tubing from the soil.

SUMMARY

Embodiments of the present disclosure solve the above disadvantages by providing methods, and apparatuses used in those methods, of countersinking injection tubing below the surface of a structure such that it will not extend above the surface of the structure even after movement of the soil, for example, due to frost heave or shrink-swell.

Some embodiments of the methods of the present disclosure include a method for increasing the bearing capacity of soil comprising: placing an injection tube into soil beneath a structure (or where a structure will be built), the structure (or to-be-built structure) having a surface, and the injection tube having a first end, a second end spaced apart from the first end, and a length extending between the first end and the second end, where the length of the injection tube is shorter than a distance from the surface to a desired depth for injecting material into the soil; advancing the injection tube into the soil until the first end is at the desired depth; and injecting material through the injection tube when the first end is at the desired depth. The material can be injected into and through the injection tube via an injection gun or other injection system. The second end of the injection tube will be below the surface of the structure (or the to-be-built structure) when the first end of the injection tube is at the desired depth, for example, between approximately 8 and 10 inches below the structure surface or whatever depth is needed (including a safety factor, if desired) to prevent any portion of the tube from being pushed above the surface of the structure when the soil settles, heaves, contracts or otherwise moves. The material injected into the soil can be any kind of material for stabilizing the soil, including expansive polyurethane or other expansive materials. The injection tube can be placed in the soil by pre-drilling a hole and placing the injection tube into the hole or by other means such as driving the injection tube directly into the soil. For example, the injection tube can be a hollow helical pier driven (e.g., while being rotated) into the soil through which material is directly injected.

Some embodiments of the methods of the present disclosure further include coupling a first end of an injection tube extension to the second end of the injection tube, the injection tube extension have a second end spaced apart from the first end of the injection tube extension, and a length extending between the first end and the second end of the injection tube extension; advancing the injection tube extension into the soil until the first end of the injection tube is at the desired depth; and, after injecting material through the injection tube at the desired depth, removing the injection tube extension from the soil. The injection tube extension can be coupled to the injection tube by a friction, threaded, and/or other connection. The injection tube extension can be removed from the soil before the injected material substantially cures within it, for example, within 1 minute or less of ceasing to inject material through the injection tube, depending on the curing rate of the material and the diameter of the tube. The gap created by the removal of the injection tube extension from the soil can be filled with filler material, such as aggregate, concrete, or cement. At least a portion of the injection tube extension can extend above the surface of the structure after the injection tube is advanced to the desired depth, including the second end. This portion (including the second end) can be coupled (e.g., via a friction, threaded, and/or other connection) to an injection tube advancer before being advanced into (or further into) the soil. The injection tube advancer can be coupled to a tool capable of advancing the injection tube into the soil, such as a hammer drill. After advancing the injection tube and the injection tube extension into the soil to the desired depth, the injection tube advancer can be removed (i.e., decoupled) from the injection tube extension. The injection tube advancer can be, but need not be hollow.

Some embodiments of the apparatuses of the present disclosure include an injection tube having a first end, a second end spaced apart from the first end, a length extending between the first end and the second end, and an injection tube lumen extending the length of the injection tube. The injection tube can be configured to be positioned in soil such that the second end is below a surface of a structure positioned on the soil when the first end is at a desired depth for injecting material into the soil.

Some embodiments of the apparatuses of the present disclosure further include an injection tube extension having a first end, a second end spaced apart from the first end of the injection tube extension, a length extending between the first end and the second end of the injection tube extension, and an injection tube extension lumen extending the length of the injection tube extension. The first end of the injection tube extension can be configured to be coupled to the second end of the injection tube such that the injection tube extension lumen is in fluid communication with the injection tube lumen when they are coupled. The injection tube extension can be further configured such that at least a portion of the injection tube extension extends above the structure surface when the first end of the injection tube is at the desired injection depth.

Some embodiments of the apparatuses of the present disclosure further include an injection tube advancer having a first end and a second end spaced apart from the first end of the injection tube advancer. The first end of the injection tube advancer can be configured to be coupled to the second end of the injection tube extension (e.g., such that the forces imparted on the first end of the injection tube advancer are transferred through the injection tube advancer to the second end of the injection tube extension). The second end of the injection tube advancer can be configured to be coupled to a tool for advancing the injection tube into soil, such as a hammer drill.

When referring to coupling to an "end" of a component, it is understood that this includes coupling to an "end portion" of the component. The terms "a" and "an" are defined as one or more unless this disclosure explicitly requires otherwise. The term "approximately" is defined as "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb. Any methods including steps are not, but can be, limited to the order of the steps recited in the method.

The feature or features of one embodiment may be applied to other embodiments, even though not described or illustrated, unless expressly prohibited by this disclosure or the nature of the embodiments.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale for at the least the embodiments shown.

DESCRIPTION OF ILLUSTRATIVE EMBODIMENTS

Figure 1A:
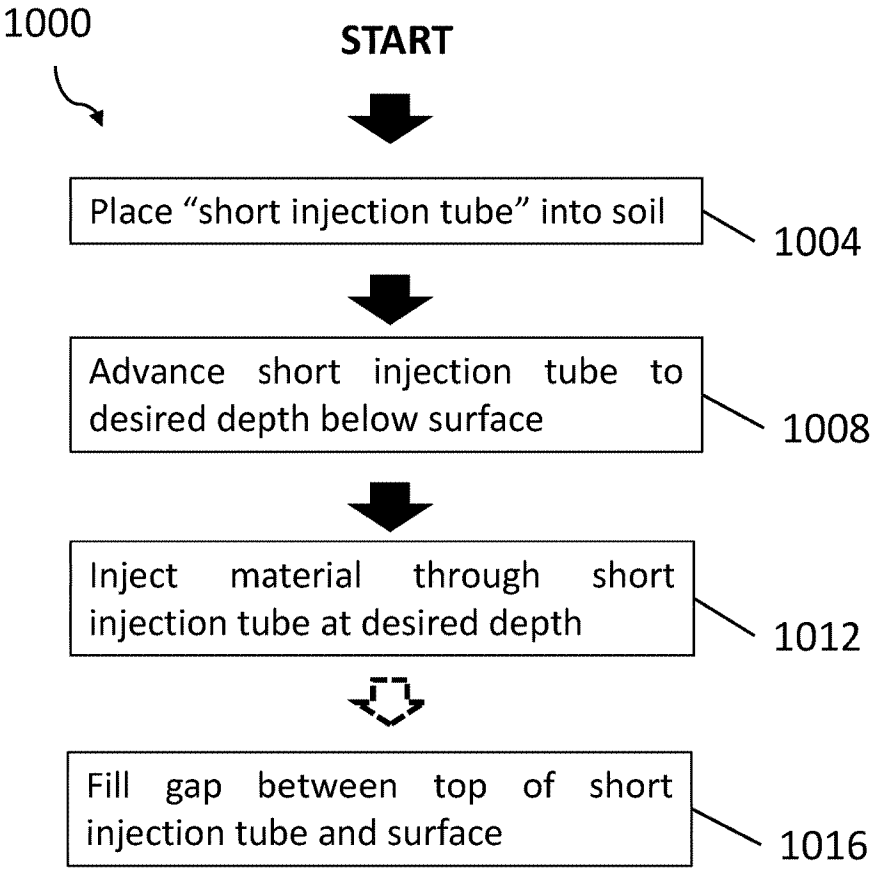
FIGS. 1*a* and 1*b* depict a flow chart of methods of soil stabilization according to some embodiments of the disclosure.

Referring now to the drawings, and more particularly to FIG. 1*a*, shown there and designated by the reference numeral 1000, is an example method of soil stabilization according to an embodiment of the disclosure. At step 1004, a "short injection tube" is placed into soil to be stabilized by, for example, an operator. A "short injection tube," as used herein, is an injection tube that is shorter in length than the distance to the desired depth for injection of material into the soil. This "distance to the desired depth" may simply be the desired depth directly below a surface of a structure, or it may be a greater distance than the desired depth if the tube is to be placed into the soil at an angle from the surface. A "short injection tube" can be less than the distance to the desired depth by whatever distance is needed (including a safety factor, if desired) to prevent any portion of the short injection tube from extending above the structure surface over time, for example due to frost heave. This distance may or may not depend on the thickness of the structure on the soil (i.e., the distance from the soil surface to the structure surface through which the injection tube is placed). When dependent on the thickness of the structure, the distance can (but need not) be between approximately 66% and 83% of the thickness of the structure. For example, if the structure is pavement and the pavement is 6 inches thick, the short injection tube can be "short" approximately 4 to 5 inches. If the pavement is 12 inches thick, the injection tube can be "short" approximately 8 to 10 inches. If the pavement is 18 inches thick, the injection tube can be "short" approximately 12 to 15 inches. The short injection tube of method 1000 can be made from plastic, metal, and/or other materials. Step 1004 can be performed by pre-drilling a hole to the desired depth for injection and placing the short injection tube within the hole. The top of the short injection tube can be approximately flush with the surface of a structure, or just below it. At step 1008, the short injection tube is advanced into the soil until its bottom end is at the desired depth for injecting material into the soil. Because the injection tube is "short," its top end will be below the surface of the structure following step 1008. In step 1012, material, such as expansive polyurethane material, is injected through the short injection tube into the soil at the desired depth. Following injection of the material, the short injection tube can be left in the soil. Removing the injection tube from the soil after or during material curing can damage the injected material and destabilize the soil. At step 1016, the gap in the soil between the surface of the structure and the top of the short injection tube can optionally (as indicated by the dashed arrow in FIG. 1*a*) be filled with filler material, such as aggregate, cement, or concrete.

Figure 1B:
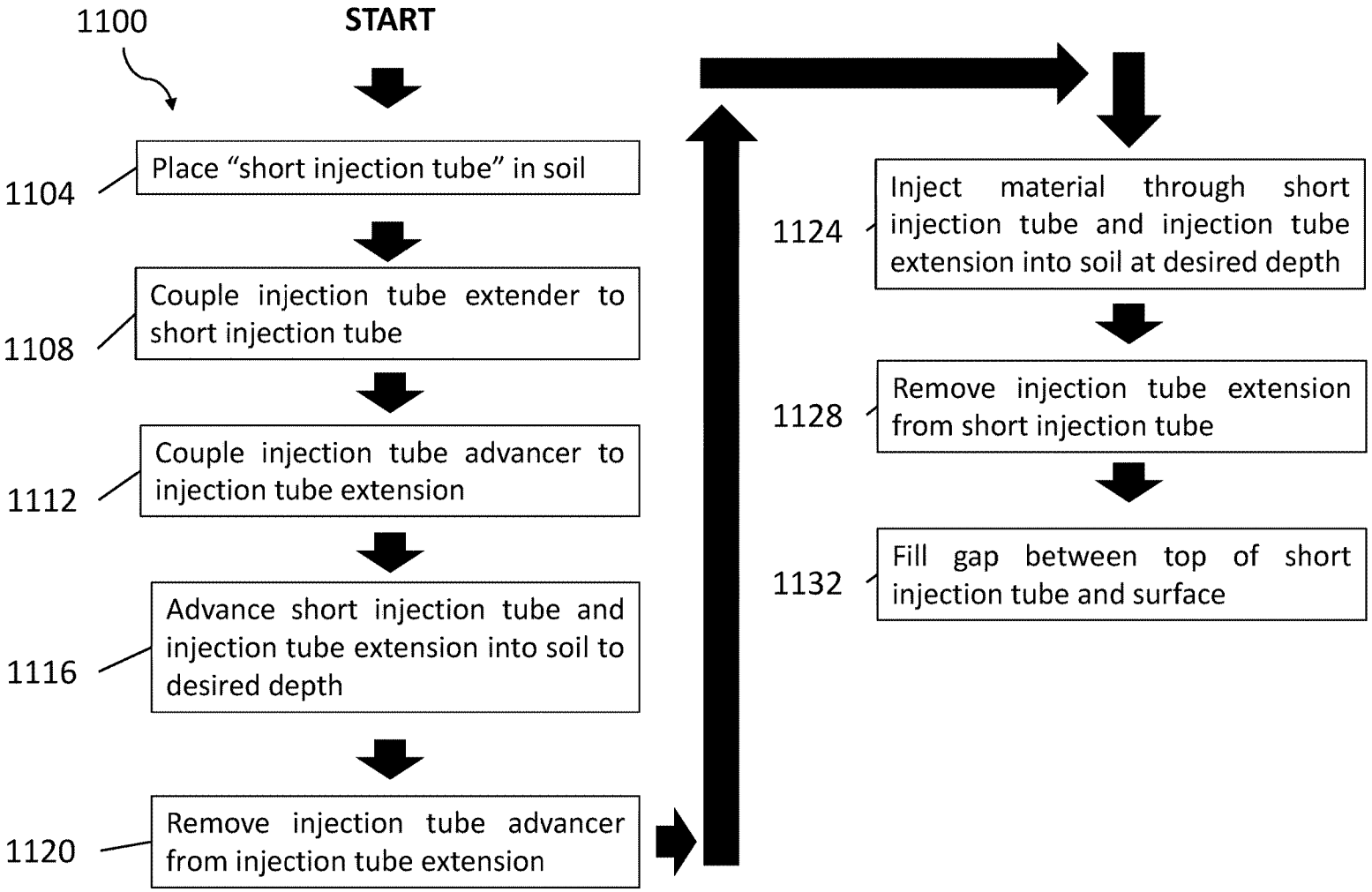

FIG. 1*b* discloses an example method 1100 of soil stabilization according to an embodiment of the present disclosure. At step 1104, a short injection tube is placed, for example, by an operator, into soil to be stabilized. The short injection tube of method 1100 can be made from plastic, metal, and/or other materials. Step 1104 can be performed by pre-drilling a hole to the desired depth for injection and placing the short injection tube within the hole. The top of the short injection tube can be approximately flush with the surface of a structure, or just below it.

At step 1108, an injection tube extension is coupled to the "short injection tube." The injection tube extension can be made from the same or different material(s) than the short injection tube. An embodiment of an injection tube extension 300 is shown in FIGS. 3*a* and 3*b*. Injection tube extension 300 has a length 356, a first end 304, and a second end 308. A lumen 340 (of multiple diameters) runs along the length 356 from end 304 to end 308. End 304 has an outer diameter 324 that is less than outer diameter 320 of end 308 and runs from end 304 a length 344 to outer surface 312. Outer diameter 320 of injection tube extension 300 runs a length 348 from outer surface 312 to end 308. Injection tube 300 also has an inner diameter 336 that runs a length 328 from end 304 to inner surface 316 within injection tube 300; and an inner diameter 332 that is greater than inner diameter 336 and runs a length 352 from inner surface 316 to end 308. The configuration of the inner/outer diameters and lengths of injection tube extension 300 can allow it to be coupled to an injection tube, such as the short injection tube of methods 1000, 1100, and/or an injection tube advancer, such as injection tube advancer 400 of FIG. 4. For example, a short injection tube (such as that of methods 1000, 1100) can have an inner diameter at one end that is greater than outer diameter 324 but not greater than outer diameter 320, such that end 304 can be run into the short injection tube until outer surface 312 abuts an end of the short injection tube. This connection can be secured by friction, threading, gravity, or otherwise, or a combination of some or all of these. When coupled, a lumen of the short injection tube can be in fluid communication with lumen 340 of injection tube extension 300. The outer diameter of the short injection tube can be the same as outer diameter 320 so that both the short injection tube and injection tube extension 300 fit within a pre-drilled hole, such as hole 204 of FIGS. 2*a*-2*e*.

Figure 4:
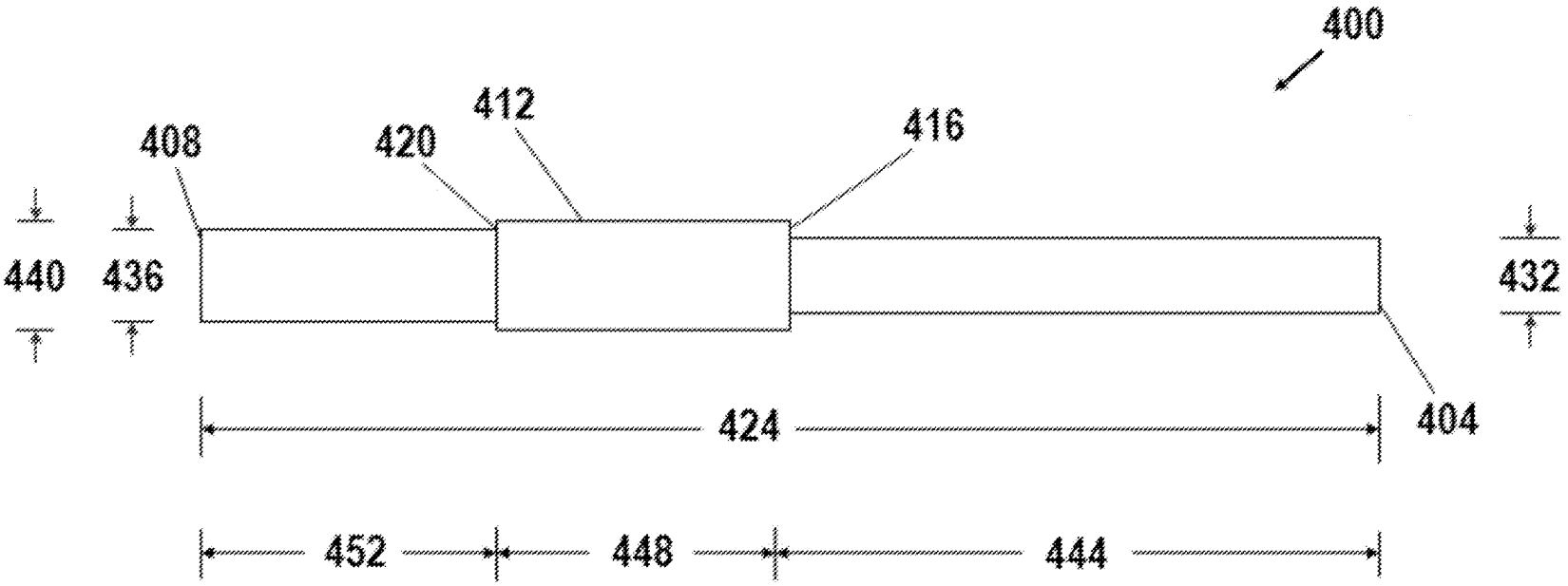
FIG. 4 depicts a side view of an injection tube advancer according to some embodiments of the disclosure.

Referring back to FIG. 1*b*, at step 1112, an injection tube advancer is coupled to the injection tube extension. The injection tube advancer can be made from the same or different material(s) than the injection tube extension and/or short injection tube. An embodiment of an injection tube advancer 400 is shown in FIG. 4. Injection tube advancer 400 has a length 424, a first end 404, a second end 408, and a raised portion 412. End 404 has an outer diameter 432 that is less than outer diameter 436 of end 408 and less than outer diameter 440 of raised portion 412. Outer diameter 436 is less than outer diameter 440. Outer diameter 432 runs a length 444 from end 404 to outer surface 416, which forms an end of raised portion 412. Outer diameter 440 runs a length 448 from outer surface 416 to outer surface 420, which forms a second end of raised portion 412. Outer diameter 436 runs a length 452 from outer surface 420 to end 408. The configuration of the inner/outer diameters and lengths of injection tube advancer 400 can allow it to be coupled to an injection tube extension, such as the injection tube extension of methods 1000, 1100 (e.g., injection tube extension 300), and/or an advancing tool, such as a hammer drill. For example, outer diameter 432 can be less than inner diameter 332 of injection tube extension 300 such that end 404 of injection tube advancer 400 can be run into injection tube extension 300 through end 308 until end 404 abuts inner surface 316, or outer surface 416 abuts end 308, or both. For example, length 444 can be equal to or approximately equal to length 352. The connection between injection tube advancer 400 and injection tube extension 300 can be secured by friction, threading, gravity, or otherwise, or a combination of some or all of these.

Injection tube advancer 400 can similarly be coupled to an advancer tool, such as a hammer drill, by, for example, inserting end 408 into an opening of the tool until a portion of the tool abuts surface 420, or end 408 abuts an inner surface of the tool, or both. Injection tube advancer 400 can be coupled to an advancer tool in other configurations as well, depending on the tool and/or other considerations of the operation. For example, portions of injection tube advancer 400 can be hollow such the advancer tool can be run into injection tube advancer 400 through end 408. The connection between injection tube advancer 400 and the advancer tool can be secured by friction, threading, gravity, or otherwise, or a combination of some or all of these.

Referring back to FIG. 1*b*, at step 1116, the short injection tube and injection tube extension are advanced into (or further into) the soil to the desired depth. The short injection tube and injection tube extension may be advanced by coupling an advancing tool, such as a hammer drill, to the upper end portion of an injection tube and using, for example, via an operator, the advancing tool to force the short injection tube and injection tube extension into (or further into) the soil via the injection tube advancer. At step 1120, the injection tube advancer may be removed (i.e., decoupled) from the injection tube extension. At step 1124, materials, such as expansive polyurethane, grout, or other soil stabilizing materials, are injected through the injection tube extension and short injection tube into the soil at the desired depth. Such injection can be performed by, for example, coupling an injection gun or other system to an upper end of the injection tube extension, and injecting the material into the injection tube extension.

At step 1128, the injection tube extension is removed (i.e., decoupled) from the short injection tube. Removal of the injection tube extension from the soil can occur as quickly as possible after the final material has been injected into the soil, such as before a majority of the material cures/hardens (and/or all of the material substantially cures/hardens) within the injection tube extension. For example, the injection tube extension can be removed within 5 minutes, 1 minute, 30 seconds, 10 seconds, 5 seconds, or less following injection of a desired amount of material into the soil. Because the injection tube extension is very short (relative to the injection depth), it can be removed during curing of the material without significantly damaging the injected material or destabilizing the soil. Removing the injection tube extension will leave a gap between the surface of the structure and the top of the short injection tube. This gap may be filled with filler material such aggregate, concrete, and/or cement, according to step 1132. After the gap is filled with filler material, the surface of the structure can be finished, if desired.

Figure 2A:
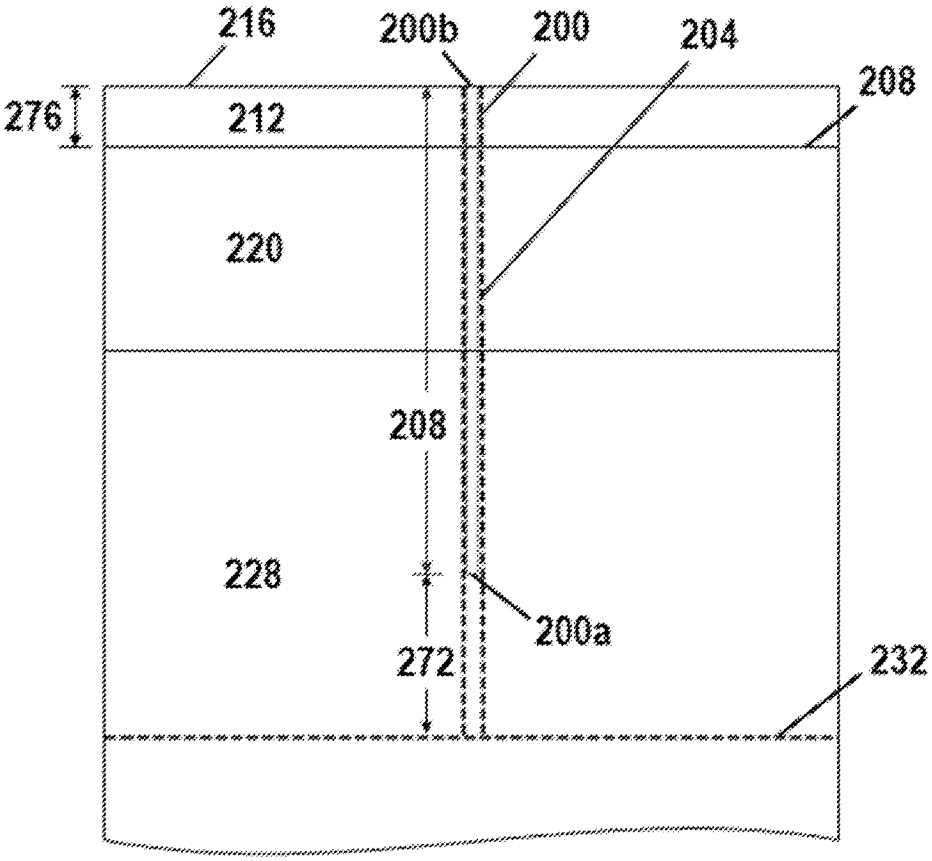
FIGS. 2*a*-2*e* depict example configurations of the method of FIG. 1*b* following performance of certain steps of the method of FIG. 1*b*, as explained herein.

Referring now to FIGS. 2*a*-2*e*, example configurations of the soil stabilization method 1100 of FIG. 1*b* (following performance of certain of the steps) are shown. For example, FIG. 2*a* shows an example configuration of method 1100 following performance of step 1104. An injection tube 200 is placed within a pre-drilled hole 204, which runs through structure 212, compact soil 220, and loose soil 228. The desired depth for injecting material to stabilize the soil is shown by line 232 within loose soil 228 at the bottom of hole 204. It is understood that this desired depth can be at any location within the soil, including within soil 220. Structure 212 can be a foundation, a bottom of a building, a road, a runway, pavement, and/or another structure. Structure 212 can also be placed over soil 220 and 228 after or during performance of method 1100. Injection tube 200 is a "short injection tube" because its length 208 is less than the distance to depth 232 from surface 216 of structure 212, specifically by distance 272. Distance 272 can be a lesser distance than shown in FIG. 2*a* (i.e., injection tube 200 can have a longer length 208); for example, distance 272 can be between approximately 66% and 83% of the distance 276 from surface 216 of structure 212 to top surface 208 of compact soil 220, or whatever distance is needed to prevent injection tube 200 from extending above surface 216 if the soil shifts, for example due to frost heave or shrink-swell. The top end 200*b* of injection tube 200 is approximately flush with surface 216 of structure 212.

Figure 2B:
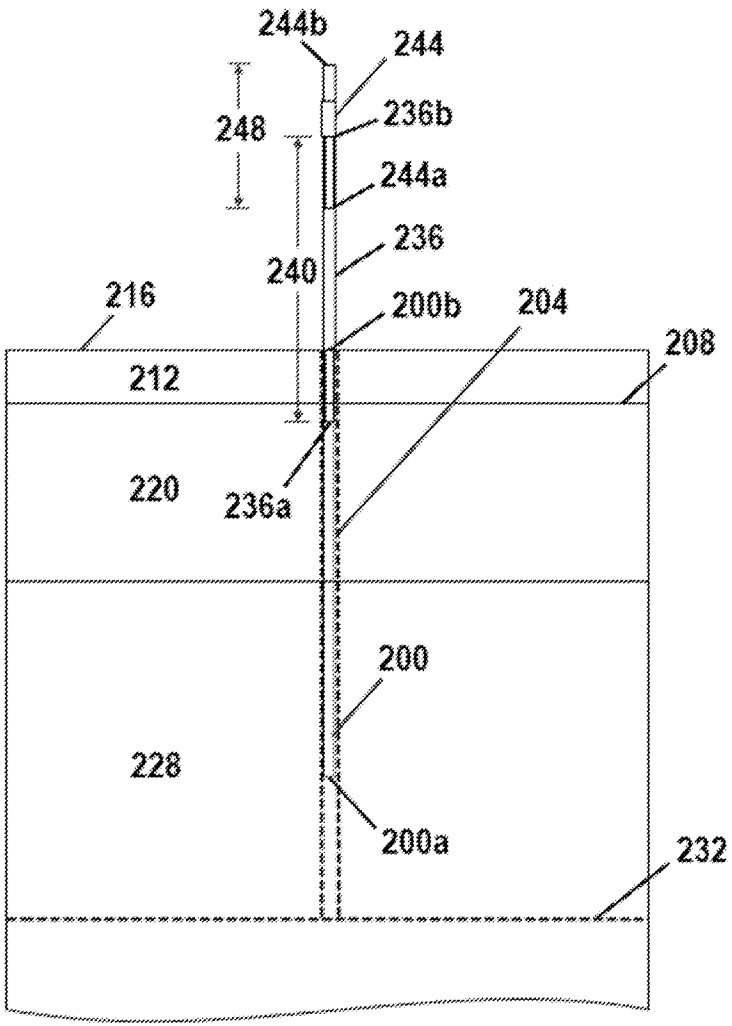
Figure 3A:
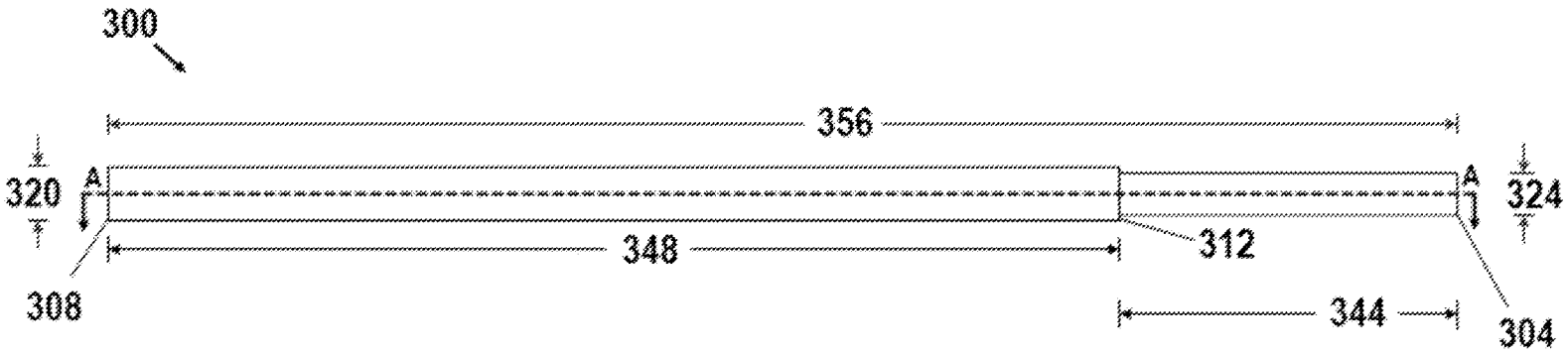
FIGS. 3*a* and 3*b* depict a side view and a cross-sectional view (along the line A-A of FIG. 3*a*), respectively, of an injection tube extension according to some embodiments of the disclosure.
Figure 3B:
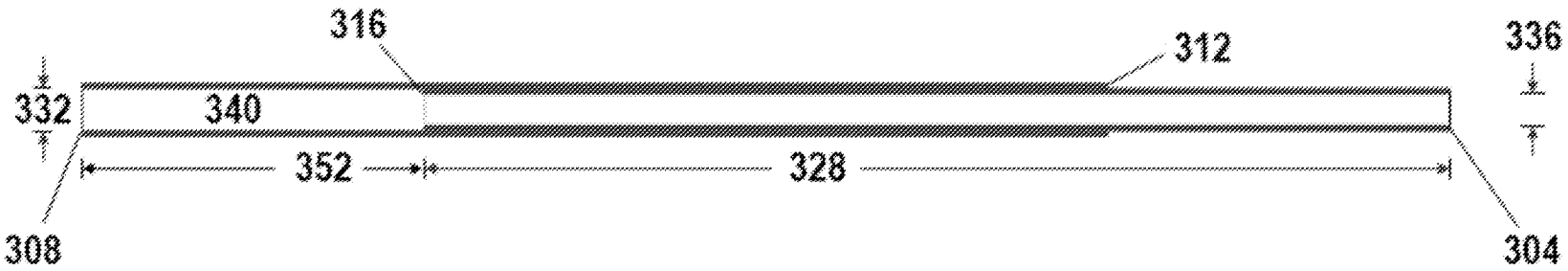

Referring to FIG. 2*b*, an example configuration of the soil stabilization method of FIG. 1100 following performance of steps 1108 and 1112 is shown. Short injection tube 200 is coupled at its upper end 200*b* to the bottom end 236*a* of injection tube extension 236; and the top end 236*a* of injection tube extension 236 is coupled to the bottom end 244*a* of injection tube advancer 244. Injection tube extension 236 has a length 240 between its bottom end 236*a* and its top end 236*b*. Injection tube extension 236 extends above surface 216 by a length greater than the difference between the distance from surface 216 to the desired injection depth 232 and length 208 of short injection tube 200. In this way, injection tube extension 236 will at least partially extend above surface 216 after end 200*a* of short injection tube 200 is advanced to depth 232.

Figure 2C:
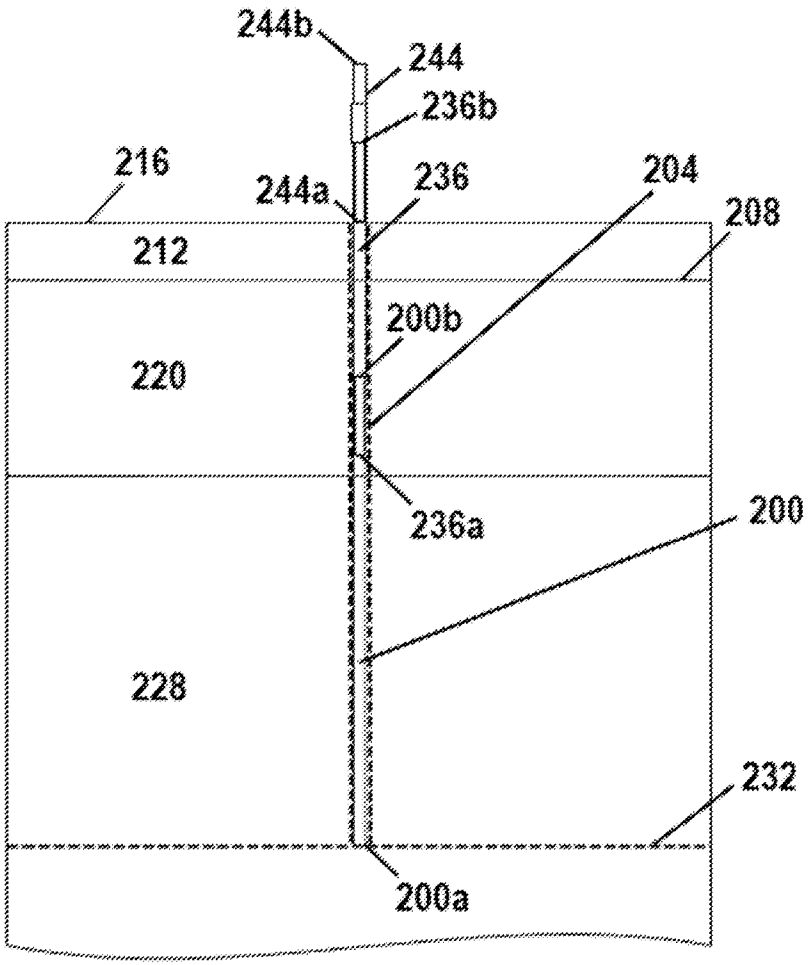

Referring to FIG. 2*c*, an example configuration of the soil stabilization method of FIG. 1100 following performance of step 1116 is shown. The bottom end 200*a* of injection tube 200 has been advanced to desired depth 232, and a portion of injection tube extension 236, as well as injection tube advancer 244, is protruding above surface 216.

Figure 2D:
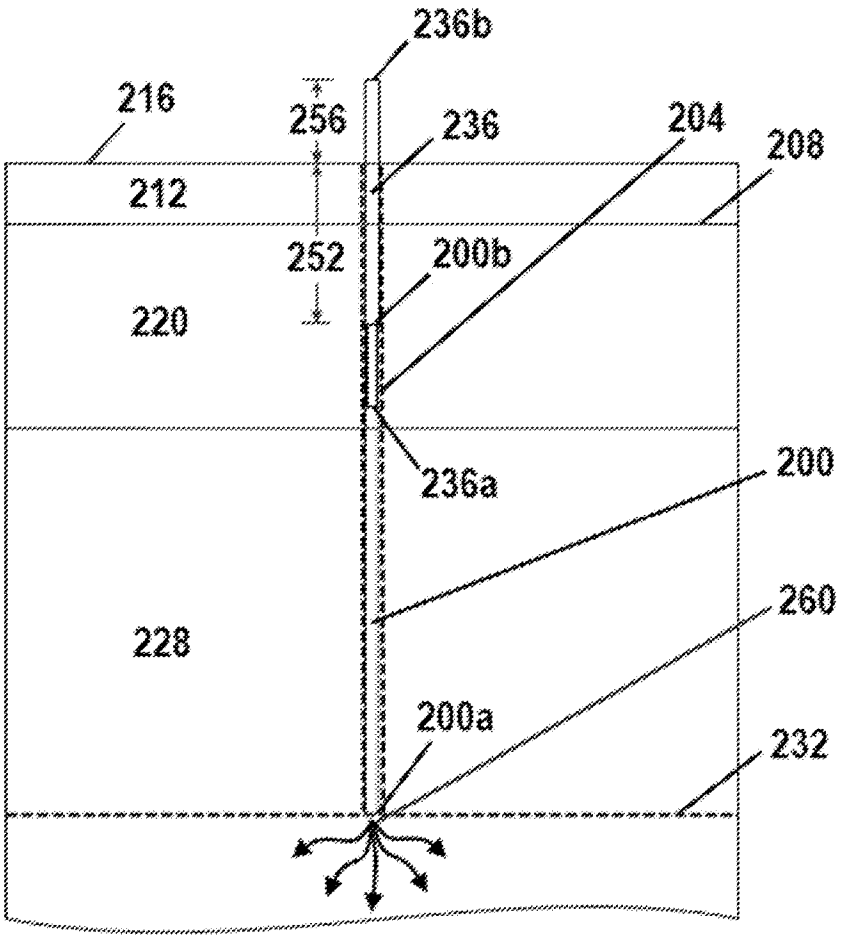

Referring to FIG. 2*d*, an example configuration of the soil stabilization method of FIG. 1100 following performance of steps 1120 and 1124 is shown. Injection tube advance 244 has been removed (i.e., decoupled) from injection tube extension 236. A portion 252 of injection tube extension 236 extends through structure 212 and into compact soil 220; and a portion 256 extends above surface 216 of structure 212. Portion 256 can couple to an injection apparatus, such as an injection gun, in various ways (e.g., by coupling about the outer diameter, within the upper inner diameter, or directly to upper end 236*a*). As shown in FIG. 2*d*, expansive polyurethane material 260 has been injected through injection tube extension 236 and short injection tube 200 into loose soil 228 at depth 232. Material 260 can expand to densify loose soil 228 to effect soil stabilization.

Figure 2E:
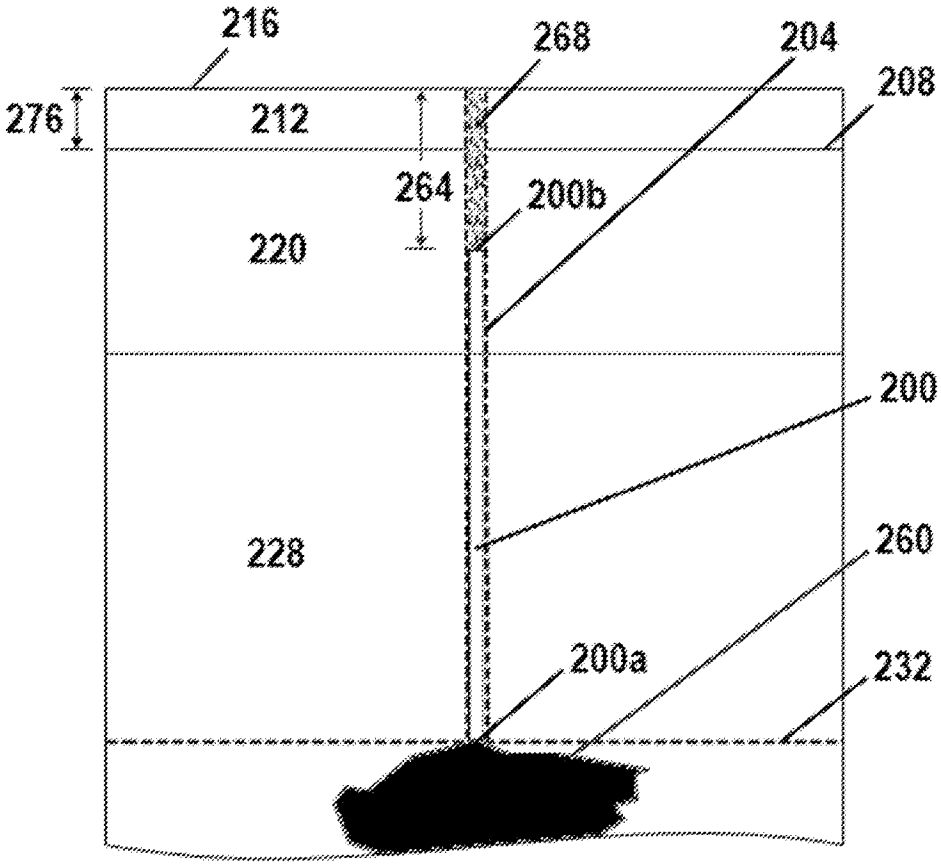

Referring to FIG. 2*e*, an example configuration of the soil stabilization method of FIG. 1100 following performance of steps 1128 and 1132 is shown. A desired amount of expansive polyurethane material 260 has been injected into loose soil 228 and has cured or is curing. Injection tube extension 236 has been removed (i.e. decoupled) from short injection tube 200 and from hole 204 before a significant amount of polyurethane material cured within injected tube extension 236. Space 264 within hole 204 between the surface 216 of structure 212 and end 200*b* of short injection tube 204 has been filled with aggregate 268. Space 264 can also have a depth that is a lesser distance than shown in FIG. 2*e* (i.e., if injection tube 200 has a longer length 208); for example, space 264 can be between approximately 66% and 83% of distance 276, or whatever distance is needed to prevent injection tube 200 from extending above surface 216 if the soil shifts, for example due to frost heave or shrink-swell.

The claims are not intended to include, and should not be interpreted to include, means-plus- or step-plus-function limitations, unless such a limitation is explicitly recited in a given claim using the phrase(s) "means for" or "step for," respectively.

Although the present disclosure and its advantages have been described in detail, it should be understood that various changes, substitutions and alterations can be made herein without departing from the spirit and scope of the design as defined by the appended claims. The scope of the present application is not intended to be limited to the particular embodiments of the process, machine, manufacture, composition of matter, means, methods and/or steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. The scope of the present application is not intended to be limited to the particular embodiments of the process, machine, manufacture, composition of matter, means, methods and steps described in the specification.

What is claimed is:

1. A method for increasing the bearing capacity of soil comprising:

placing an injection tube into soil beneath a structure, the structure having a surface, and the injection tube having a first end, a second end spaced apart from the first end, and a length extending between the first end and the second end of the injection tube, where the length of the injection tube is shorter than a distance from the surface to a desired depth for injecting material into the soil;

coupling a first end of an injection tube extension to the second end of the injection tube, the injection tube extension having a second end spaced apart from the first end of the injection tube extension, and a length extending between the first end and the second end of the injection tube extension;

coupling a first end of an injection tube advancer to the second end of the injection tube extension, the injection tube advancer having a second end spaced apart from the first end of the injection tube advancer, where the injection tube advancer is configured to be coupled to a tool capable of advancing the injection tube into the soil;

coupling the second end of the injection tube advancer to a hammer drill;

advancing the injection tube and the injection tube extension into the soil until the first end of the injection tube is at the desired depth;

injecting material through the injection tube when the first end of the injection tube is at the desired depth, where the second end of the injection tube is entirely below the surface when the first end of the injection tube is at the desired depth; and after injecting material through the injection tube at the desired depth, removing the injection tube extension from the soil.

2. The method of claim 1, further comprising removing the injection tube advancer from the injection tube extension prior to injecting material through the injection tube.

3. A system for advancing an injection tube into soil comprising:

an injection tube have a first end, a second end spaced apart from the first end, a length extending between the first end and the second end of the injection tube, and an injection tube lumen extending the length of the injection tube, where the injection tube is configured to be positioned in soil such that the second end of the injection tube is below a surface of a structure positioned on the soil when the first end of the injection tube is at a desired depth for injecting material into the soil;

an injection tube extension having a first end, a second end spaced apart from the first end of the injection tube extension, a length extending between the first end and the second end of the injection tube extension, and an injection tube extension lumen extending the length of the injection tube extension, the first end of the injection tube extension configured to be coupled to the second end of the injection tube such that the injection tube extension lumen is in fluid communication with the injection tube lumen, where the injection tube extension is configured such that at least a portion of the injection tube extension extends above the surface when the first end of the injection tube is at the desired depth; and an injection tube advancer having a first end, and a second end spaced apart from the first end of the injection tube advancer, where the first end of the injection tube advancer is configured to be coupled to the second end of the injection tube extension, where the second end of the injection tube advancer is configured to be coupled to a tool for advancing the injection tube into soil, and where the tool is a hammer drill.

4. A method for increasing the bearing capacity of soil comprising:

placing an injection tube into soil beneath a structure, the injection tube having a first end and a second end spaced apart from the first end;

coupling a first end of an injection tube extension to the second end of the injection tube, the injection tube extension have a second end spaced apart from the first end of the injection tube extension;

coupling an injection tube advancer to the second end of the injection tube extension, the injection tube advancer configured to be coupled to a tool capable of advancing the injection tube into the soil;

advancing the injection tube into the soil and the injection tube extension at least partially into the soil until the first end of the injection tube is at a desired injection depth in the soil;

removing the injection tube advancer from the second end of the injection tube extension;

injecting expansive material through the injection tube and injection tube extension when the first end of the injection tube is at the desired depth;

removing the injection tube extension from the second end of the injection tube; and filling the space in the soil created by removing the injection tube extension with filler material.

5. The method of claim 4, further comprising stopping injection of material into the soil, and removing the injection tube extension from the soil within one minute of the stopping.

* * * * *